United States Patent [19]

Morganroth

[11] 4,273,144

[45] Jun. 16, 1981

[54] HAIR PARTING AND LIQUID SPREADING DEVICE

[76] Inventor: Shila Morganroth, 20413 Willowick Dr., Southfield, Mich. 48075

[21] Appl. No.: 859,740

[22] Filed: Dec. 12, 1977

Related U.S. Application Data

[63] Continuation-in-part of Ser. No. 592,764, Jul. 2, 1975, Pat. No. 4,211,247.

[51] Int. Cl.[3] ..... A45D 40/26

[52] U.S. Cl. ..... 132/88.7

[58] Field of Search ..... 132/88.7, 88.5, 9, 116; 401/208, 218; 15/140.3, 121

[56] References Cited

U.S. PATENT DOCUMENTS

| | | | |
|---|---|---|---|
| 1,531,245 | 3/1925 | Ozanne | 15/140.3 |
| 2,584,735 | 2/1952 | Pancoast | 15/121 |
| 2,819,723 | 1/1958 | Meyer | 132/116 |
| 2,932,045 | 4/1960 | Rabelow | 401/218 |
| 3,027,591 | 4/1962 | Petersen | 401/208 |
| 3,204,644 | 9/1965 | McDougall-Kaley | 132/9 |
| 3,570,499 | 3/1971 | Ruta | 132/9 |
| 4,011,879 | 3/1977 | Roberts | 132/9 |

*Primary Examiner*—G. E. McNeill

*Attorney, Agent, or Firm*—George H. Mortimer

[57] ABSTRACT

The present invention relates to a tool or device for use in hair color altering procedures having means for parting the hair and for dispensing and spreading hair color altering liquids into the hair, particularly in the root area.

In a preferred form the device is in the form of a closure means with a cylindrical, internally threaded collar to secure it in liquid tight relation to a squeeze bottle. A long, slender and preferably tapering parting tool extends upwardly from the closure means around a discharge outlet. The axis of the parting tool may be aligned with or offset from the axis of the collar, or be tilted in or out with respect to that axis. Attachments may be used on the parting tool to improve its liquid spreading ability. The squeeze bottles may be non-symmetrical or symmetrical about an axis aligned with the axis of the collar and of cylindrical or conical shape, with or without a shoulder at the neck end. The parting tool may be given an inward tilt, even if its axis is parallel with the axis of the collar, by giving the collar a tilt from a plane parallel with the flat bottom of the bottle by the shape of the bottle or by an attachment. If desired the parting tool may be pivotally mounted on the cap for movement of its axis to any desired relation with the axis of the collar. The parting tool may also be mounted on the bottle itself instead of being on a removable cap. The parting tool has a discharge passage in it to conduct liquid from the bottle to a discharge orifice on the parting tool. This discharge orifice in some embodiments may be at the end but preferably is at least partly in the side wall that serves as the spreading means to apprise the operator which way to hold the bottle. Color may also be used for this purpose.

53 Claims, 7 Drawing Figures

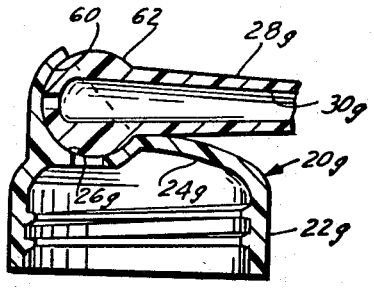
FIG. 11
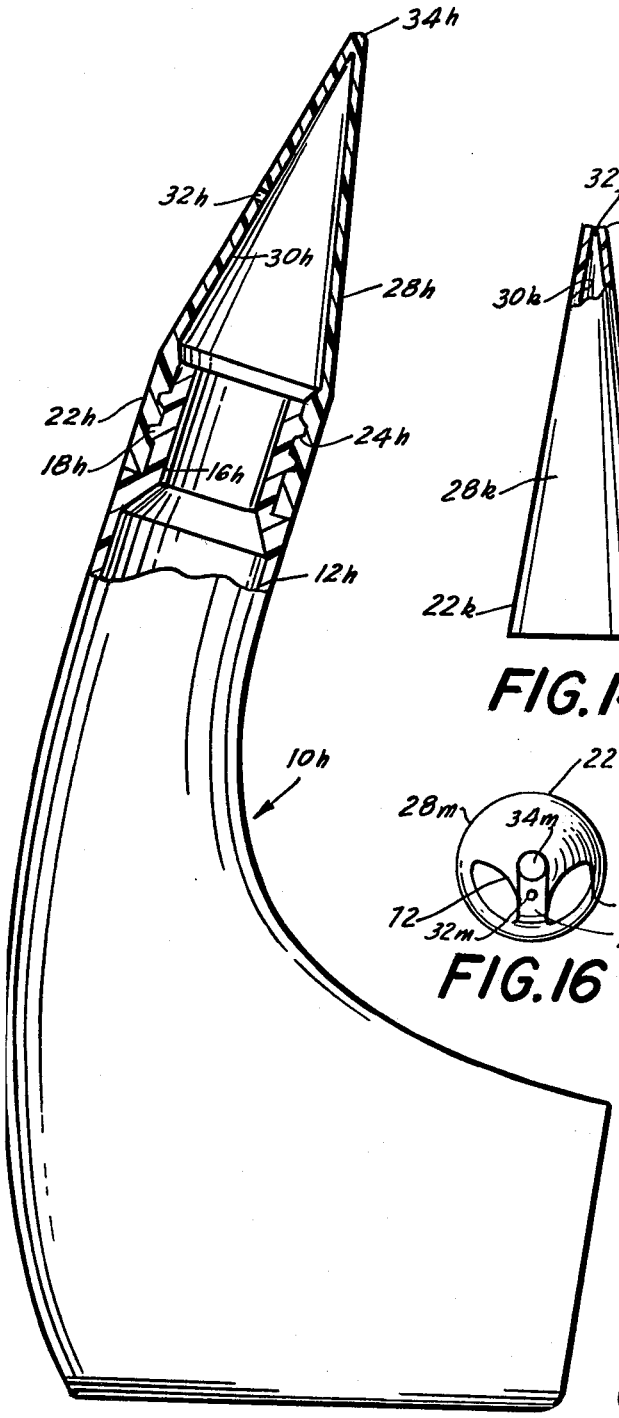
FIG. 12
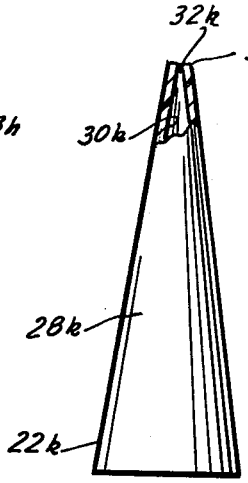
FIG. 14
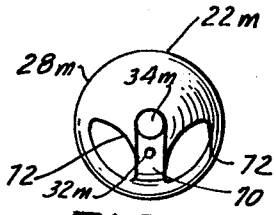
FIG. 16
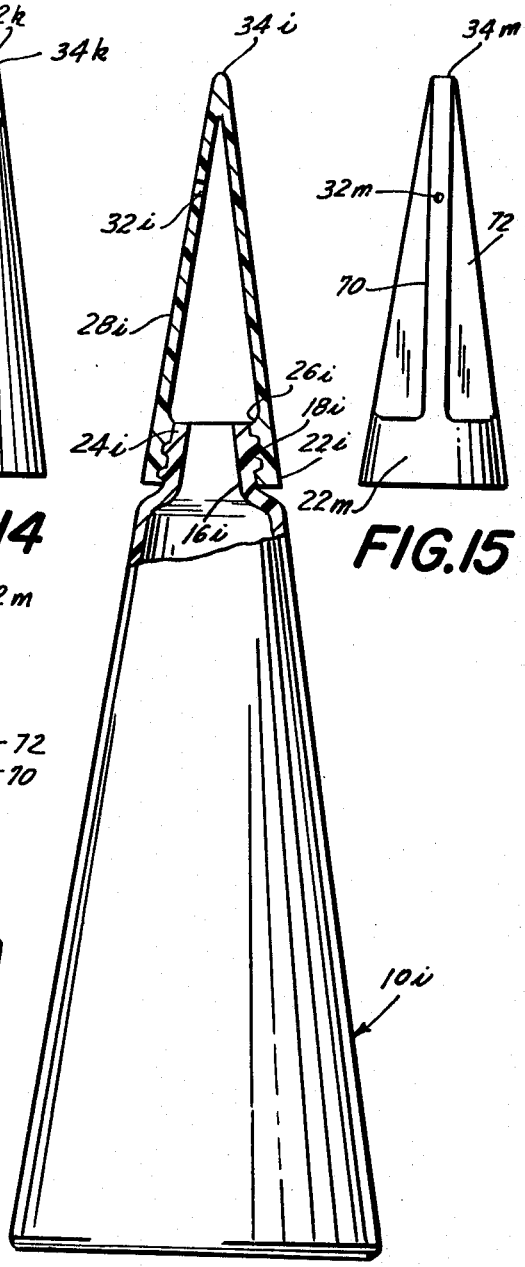
FIG. 15
FIG. 13

HAIR PARTING AND LIQUID SPREADING DEVICE

This application is a continuation-in-part of pending application Ser. No. 592,764 filed July 2, 1975 now U.S. Pat. No. 4,211,247.

The present invention relates to a tool or device for use in hair color altering procedures having means for parting the hair and for dispensing and spreading hair color altering liquids into the hair, particularly in the root area.

BACKROUND OF THE INVENTION

Many devices have been proposed for use in hair color altering procedures. Some of them are primarily for parting the hair, e.g., rat tail combs, while others are intended primarily for use in spreading the hair color altering liquids in the hair, e.g., fountain brushes and the like.

Generally speaking, the devices that are used for introducing hair color altering liquids into the hair are used in conjunction with the squeeze bottles and like containers for holding and dispensing the liquids when the beautician who uses the squeeze bottle as a handle compresses it by hand pressure and thereby creates sufficient pressure on the liquid in the container to dispense it through the device or tool into the hair.

One well known form of cap for a squeeze bottle which can be used for parting the hair and for dispensing liquid from the squeeze bottle into the hair comprises a cylindrical flange which is internally threaded to fit the thread on the neck of a squeeze bottle, a closure disc usually integral with the upper rim of the flange and a central, frustoconical elongated hollow projection integral with the closure disc and extending upwardly therefrom with its axis in the axis of the cylindrical flange (and of the squeeze bottle when the cap is screwed thereon). The projection, which serves both as a parting tool and as a discharge passage from the interior of the squeeze bottle through the projection to a discharge orifice at the end thereof, is ill adapted for spreading liquid because of its circular cross section and the obstructing parts of the cap and the shoulder of the typical squeeze bottle used with the cap, both of which are in the way of laying the projection against the scalp in trying to spread discharge liquid along the part line. This type of device, therefore, has the serious limitation that the spreading of the liquid is only ineffectively done, if at all, by the device and the usual method of spreading the liquid by beauticians who hold the bottle in one hand to part the hair and dispense the liquid along or near the part line at the scalp is to use the thumb of the other hand which holds the hair to spread the liquid upwardly from the scalp into the hair. This is a messy procedure, requiring frequent washing of the hands, and often results in sensitizing the skin to the hair color altering liquids, especially on-the-scalp type bleaches.

Another well known form of cap for a squeeze bottle which can be used for parting the hair and for dispensing liquid from the squeeze bottle into the hair comprises a cylindrical flange which is internally threaded to fit the neck of a squeeze bottle, a closure disc or dome integral with the upper end of the flange having a peripheral discharge opening surrounded by an integral, elongated hollow projection extending upwardly and outwardly with respect to the axis of the flange and of the squeeze bottle, i.e., the axis of the projection diverges from the axis of the flange from its base near the periphery of the closure disc or dome to its tip where the discharge orifice is located with the rim perpendicular to the axis of the projection. In using this form of device beauticians have been confused because they have not known which side of the projection should be used against the scalp and hair to spread color altering liquid that had been dispensed along a part line from the end discharge opening to spread it into the hair. The instructions from one manufacturer are to use the side that makes an acute angle with a plane through the open end of the flange but adjacent parts of the cap and the shoulder of the squeeze bottle prevent a beautician from laying the projection flat against the scalp too spread discharged liquid. Many beauticians thought it would be better to try to use the opposite side of the projection that makes an obtuse angle with the plane because it seemed that a greater portion of the projection would lie against the scalp but in practice they found that the portion of the cap at the side of the projection interfered with placing that side flat against the scalp and hair at the part line where the dispensed liquid is to be spread into the hair. With both available methods of use of this type of device it has been found in use that the projection is as ill adapted for spreading the discharged liquid as the first described type of cap and this has resulted in the use by beauticians of their thumbs as the spreading means with all the problems attendant thereto which have been described above.

SUMMARY OF THE PRESENT INVENTION

The present invention overcomes the difficulties and disadvantages of the prior known and proposed devices by providing a number of improvements which can be incorporated singly or together.

One improvement is to provide a discharge orifice in the elongated projection which is at least partly in a side wall thereof. This has two primary advantages. One is that a beautician by mere observation knows how to use the device to part hair and dispense and spread liquid. A second advantage is that the location of at least part of the discharge orifice in the spreading surface of the projection away from the free end improves its spreading capability. The spreading capability may also be enhanced by providing a spreading edge on the projection that has angular side edges to push the liquid into the hair from the part line rather than an edge of circular cross-section that tends to glide over it.

Another improvement is to place the lower end of the spreading surface on the projection adjacent to the flange of the removable cap, which avoids interference of the flange with the spreading operation, preferably with the spreading surface inclined toward the axis of the flange.

A further improvement is the provision of a separately molded spreading attachment for a known applicator to place the discharge orifice back from the tip of the projection and locate the lower end of the spreading surface adjacent to the flange, preferably with the spreading surface on a tilt toward the axis of the flange.

Still another improvement comprises a cap having a discharge opening with a surrounding wall forming a movable, liquid tight connection with the lower end of the projection which permits the axis of the projection to be changed with respect to the axis of the flange or collar, and even form a closure valve, if desired.

An additional improvement is the provision of a combination squeeze bottle and cap that is free of obstructions that interfere with the use of a spreading surface on the projection.

Other improvements will become apparent from the detailed description of preferred embodiments of the invention.

BRIEF DESCRIPTION OF EMBODIMENTS OF THE INVENTION

The foregoing improvements are illustrated in the accompanying drawings in which.

Figure 7:
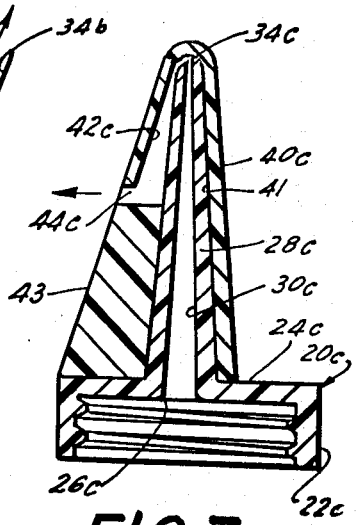
Figure 7A:
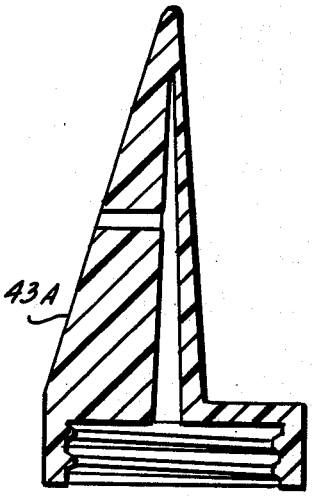

FIG. 7 is a vertical sectional view of a further embodiment of the invention utilizing a conventional, commercially available cap with a centrally located frustoconical projection over which an adapter is applied and removably held by friction which provides a discharge orifice in a side wall thereof and a sloping spreading surface extending from the free end of the projection to the edge of the flange or collar that secures the cap to a squeeze bottle;

FIG. 7A is a vertical sectional view of an embodiment similar to that shown in FIG. 7 where the sloping spreading surface is integral with the cap.

Figure 9:
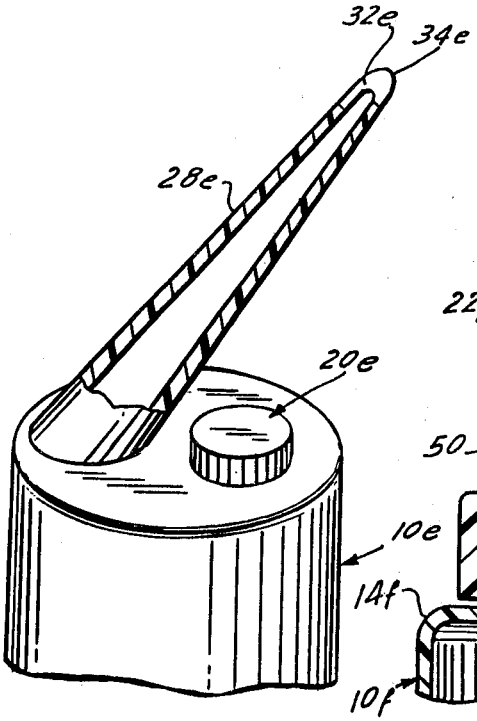
Figure 10:
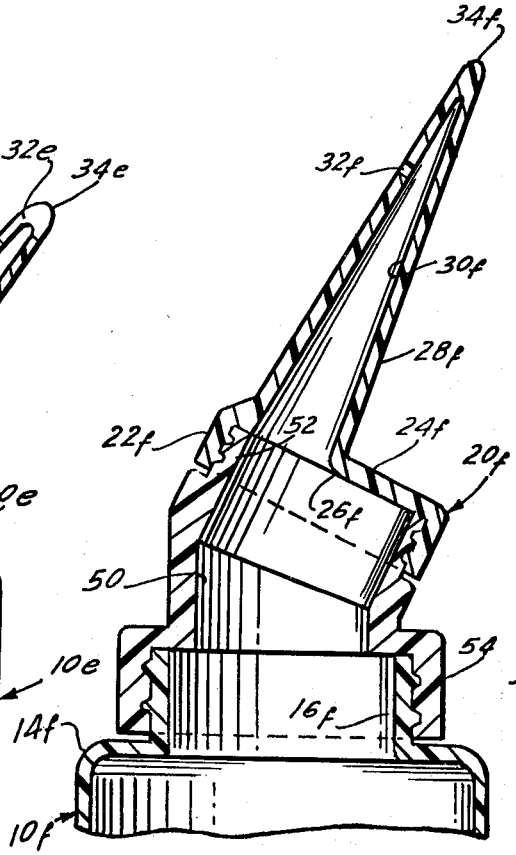
Figure 8:
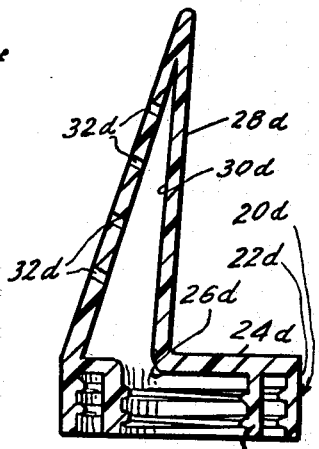

FIG. 8 is a vertical sectional view of a further embodiment of the invention in which the projection provides a spreading surface very similar to that provided by the attachment in FIGS. 7 and 7A but which is shown with a plurality of discharge orifices in the spreading surface thereof and which further has a plurality of collars or flanges which are internally threaded to receive the threads of the necks of squeeze bottles of different diameters with a discharge outlet in the closure means of the cap communicating with the space inside the innermost collar or flange;

FIG. 9 is a fragmentary perspective and partially sectional view of still another embodiment of the invention in which the projection is integral with the squeeze bottle and a separage filling opening with removable closure cap is provided for permitting introduction of a hair color altering liquid into the interior of the squeeze bottle;

FIG. 10 is a vertical sectional view of still a further embodiment of the invention in which a cap is provided having a projection connected to the closure means thereof adjacent to a flange and which has the axis of the projection parallel to but offset from the axis of the flange or collar, together with means for tilting the axis of the projection with respect to the axis of the squeeze bottle which is fragmentarily shown, and which comprises an adapter having an externally threaded flange connected with the flange of the cap and an internally threaded flange connecting the adapter to the neck of the squeeze bottle;

FIG. 11 is a fragmentary vertical sectional view of a cap having a socket for receiving the enlargement at the inner end of the projection which permits the projection to be lifted for use during parting of the hair and application of the hair color altering liquid thereto and to be pressed down to the closed position shown in FIG. 11 where the discharge passage through the projection is moved away from communication with the interior of the cap and brought into contact with the wall of the socket, thereby serving as a closure means for the bottle to which the cap is removably attached;

FIG. 12 is a front view of a squeeze bottle of generally L-shape having a bottom wall with a flat portion capable of resting on a flat surface and an upper cylindrical end with a reduced neck to which a cap is removably held by a cylindrical flange of substantially the same size as the upper cylindrical end of the bottle;

FIG. 13 is a side view of a squeeze bottle of frustoconical shape with a reduced externally threaded neck to which a conical cap is removably held by an internally threaded flange at the lower end of the cap, the diameter of the lower conical end of the cap being substantially the same as the diameter of the upper conical end of the bottle;

FIG. 14 is a side view, partly in section, showing a different embodiment of a cap for the squeeze bottle of FIG. 13;

FIG. 15 is a front view of a cap for a squeeze bottle, e.g., the bottle of FIG. 13, showing a spreading surface formed in a furstoconical projection to increase liquid spreading capability over a conically shaped projection; and FIG. 16 is a top view of the cap of FIG. 17.

DETAILED DESCRIPTION OF PREFERRED EMBODIMENTS OF THE INVENTION

Figure 1:
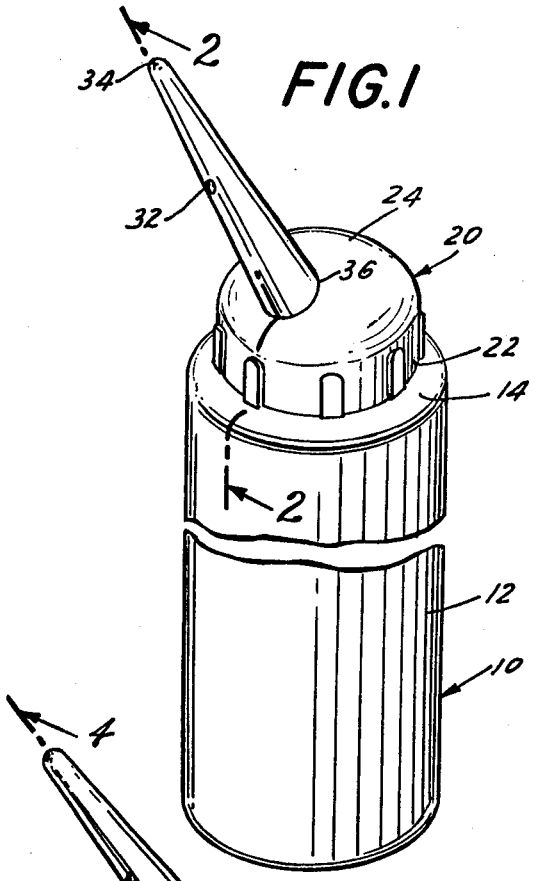
FIG. 1 is a perspective view of a squeeze bottle and applicator type cap in which the projection has a discharge orifice in a side wall thereof and is connected to the closure means of the cap adjacent to the flange or collar thereof and extends upwardly therefrom with its axis at an angle to and divergent from the axis of the collar and the bottle.
Figure 2:
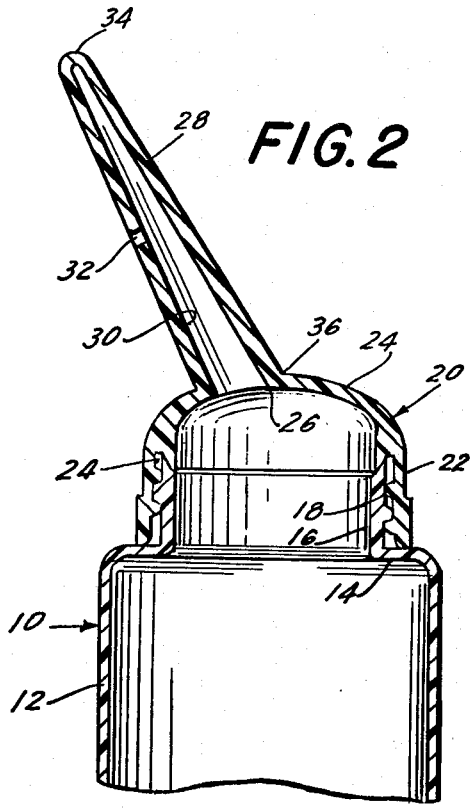
FIG. 2 is a fragmentary vertical sectional view of the devices of FIG. 1 along the line 2—2 thereof.

Referring first to FIGS. 1 and 2, a conventional squeeze bottle 10 is illustrated comprising a cylindrical wall 12, a shoulder 14 and a cylindrical neck 16 of smaller diameter than the wall 12 having an external thread 18 on which to screw a closure cap. The cap 20 has a cylindrical flange 22 with an internal thread 24 conforming with the external thread 18 so as to secure the cap in liquid tight relation to the bottle. The upper end of the flange 22 is closed by means 24 in the form of a somewhat domed end wall having a discharge outlet 26 therein which is offset from the center toward the flange or collar 22. Integral with the closure means of the cap is an elongated projection 28 of generally frustoconical shape having a discharge passageway 30 extending upwardly in the projection and making it hollow. The discharge passageway communicates both with the discharge outlet 26 and a discharge orifice 32 in the sidewall of the projection 28 a substantial distance back from the free end or tip 34 thereof, as clearly seen in both FIGS. 1 and 2. The lower end 36 which surrounds the discharge outlet 26 is the larger end of the frustoconical projection while the free end or tip 34 is the smaller end. The outer end 34 is shown somewhat rounded which facilitates use of the projection as a parting tool for the hair because it presents a smooth surface that will not catch or snag the hair as the projection is pushed through it to make a parting.

A squeeze bottle and removable cap of the type illustrated in FIGS. 1 and 2 is commercially available except that it has the discharge opening in the small, free end 34 so that the stream of liquid discharged from the bottle flows out in axial direction along the dotted line in the axis of the projection.

Referring to FIG. 2, the said axis of the projection 28 diverges from the axis of the flange or collar 22, which is also the axis of the squeeze bottle 10, as the projection rises from its lower or secured end 36. There has been much confusion among beauticians using the squeeze bottle off the prior art because they have not known the best way of holding the applicator bottle for parting, discharging and spreading the liquid into the hair. Many of them have tended to use the right hand surface, as seen in FIG. 2 as the spreading surface where others have tended to use the left hand surface. The manufacturer's instructions accompanying squeeze bottles of this type recommend that the left hand surface of the projection be down toward the scalp instead of being up when the device is used for parting and spreading. Most operators do not take the time to read the instructions but simply pick up the device and use it in a way that seems to them to be the right way. Since there is nothing about the prior bottle to indicate that the right way is, the confusion has inevitably resulted.

In the use of a bottle of the already known type, such as that illustrated in FIGS. 1 and 2 except that the discharge orifice is at the end of the projection, in hair color altering procedures, the steps comprise:

a. Placing the free end of the projection against the hairline and moving it into the hair to form a part.
b. Squeezing the bottle to force the hair color altering liquid out of the opening in the tip along the part as the bottle is moved in reverse direction.
c. Spreading the liquid that has been discharged into the hair either with the projection or with the thumb of the hand that has held the hair while the other hand discharged the liquid along the part line. This spreading operation by means of the projection requires its movement transversely of the part line to push the liquid into the hair. This is not a very effective spreading instrument and therefore most operators have used the thumb instead which has the disadvantage of dirtying the hand and of sensitizing the skin unless it is protected with a rubber or like glove which most operators do not like to wear because of the discomfort associated with having a moisture-tight covering over the entire hand.

With the device of FIGS. 1 and 2, the procedure of forming the part is essentially the same as described for the bottle which has the discharge orifice at the very end of the tip but liquid discharging and spreading operations are different because the location of the discharge orifice back a substantial distance from the tip enables the operator to squeeze the liquid from the bottle out of the discharge orifice 32 and simultaneously move the projection transversely of the part so as to spread the liquid into the hair as it is being discharged instead of being spread in a separate movement after the discharge of the liquid. This speeds up the efficiency of the operation, saves considerable time and effort and therefor represents a considerable improvement in this art.

Figure 3:
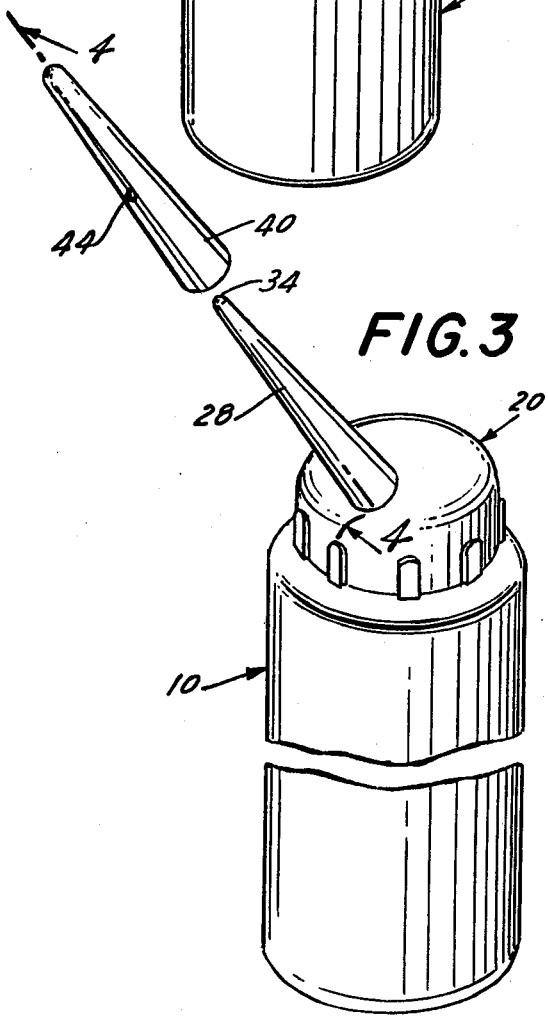
FIG. 3 is an exploded perspective view of another embodiment of the invention in which a commercially available squeeze bottle and cap is provided with a tight fitting, removable adapter to bring the discharge opening from the tip of the projection to a side wall thereof a substantial difference from the free end.
Figure 4:
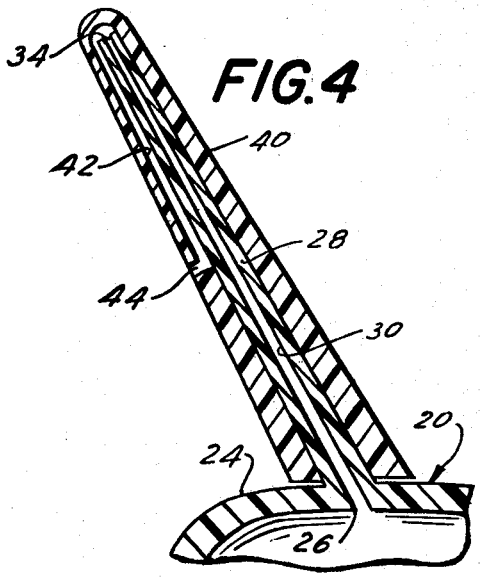
FIG. 4 is a fragmentary sectional view of the projection, the removable adapter or attachment and a portion of the closure means of the cap around the discharge opening.

FIGS. 3 and 4 include a convention squeeze bottle 10 having a cap 20 with projection 28 and discharge orifice at the free end 34. Since the parts have the same structure as the squeeze bottle and cap illustrated in FIG. 1, further description is not necessary. With this bottle an adapter 40 is used which has a frustoconical recess conforming in size and shape with the frustoconical exterior of projection 28 so that the adapter 40 can be slipped down over and be tightly held in position on the projection 28 by the frictional contact of the wall of the attachment with the wall of the projection 28. A passageway 42 is provided in the internal wall extending from the free end thereof backwardly along the interior wall to the orifice 44 so that liquid which is discharged from the squeeze bottle by application of hand pressure to the cylindrical wall 10 thereof causes the liquid to go out through the passageway 30, then backwardly through the passage 42 to the outlet 44. The embodiment of the invention illustrated in FIGS. 3 and 4 is used in the same manner as the device shown in FIGS. 1 and 2, and which need not be further described.

Figure 5:
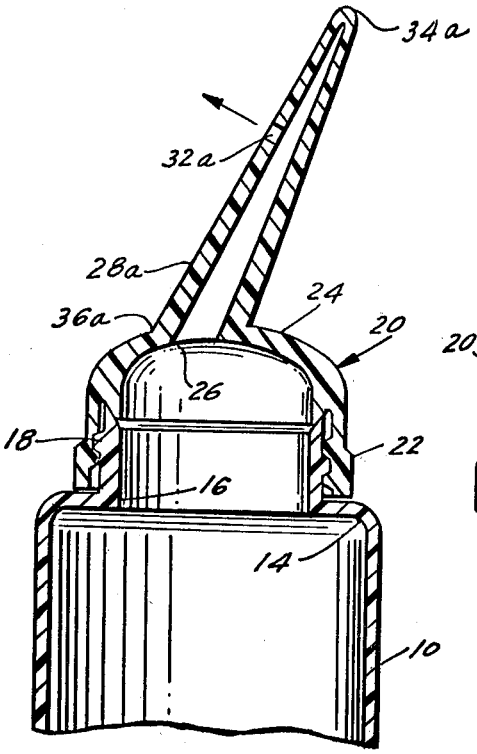
FIG. 5 is a fragmentary vertical sectional view similar to FIG. 2 except that the projection is secured to the cover means of the cap with its axis converging towards the axis of the collar and of the squeeze bottle and with the discharge opening a substantial difference from the free end of the projection.

Referring now to FIG. 5, the squeeze bottle has the same structure as that illustrated in FIG. 1 and bears the same reference characters. The cap 20 also is the same as that of FIG. 1 except that the axis of the projection **28*a* upwardly from its attached end converges toward the axis of the collar or flange 22, as clearly seen in FIG. 5**.

This angular relation of the projection give significant improvement over the prior art bottle regardless of where the discharge orifice for the liquid is located on the projection, even if it is located at the end **34*a* because it enables the projection to be used as a parting tool without bumping the head with the collar or the shoulder of the squeeze bottle and also makes it very much easier to use the left surface of the projection, as seen in FIG. 5, as the spreading surface of the projection 28*a*. It is preferred, however, to have the discharge orifice at least partially in the side wall and this is accomplished in the embodiment of FIG. 5 by placing the discharge orifice 32*a* in the left surface, as seen in FIG. 5, in essentially the same relation to the free end 34*a* as the discharge orifice 32 in FIG. 1 bears to the free end 34** thereof.

Figure 6:
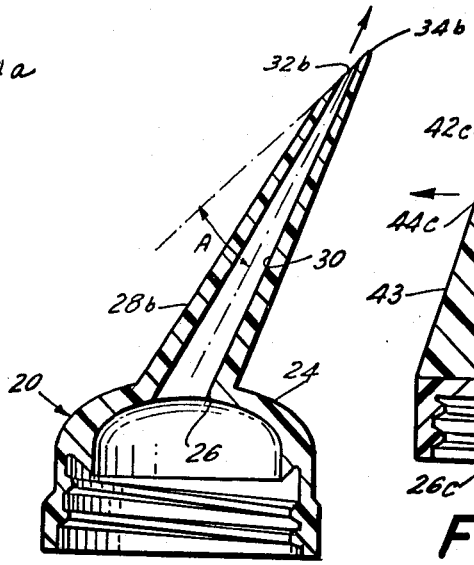
FIG. 6 is a vertical sectional view of a cap removed from a squeeze bottle which is very much like the cap of FIG. 5 except that the discharge orifice is partially in the free end and partially in the side wall of the projection by reason of the fact that the wall terminating the end thereof bears a substantial acute angular relation to the axis thereof.

The embodiment of the invention shown in FIG. 6 is essentially the same as the embodiment shown in FIG. 5 except that the discharge orifice **32*b* is only partially in the side wall of the projection 28*b*. In this embodiment the end of the projection 34*b* is cut off in a plane which bears a substantial acute angular relation to the axis of the projection, thus putting a substantial part of the orifice 32*b* in the side wall of the projection. Referring to FIG. 6, this angular relation between the plane of the end of the projection 28*b* and its axis is indicated by the letter A which in the embodiment shown is of the order of about 20°. The angle should be at least about 10° and preferably not greater than 45°. Within this range the opening in the side wall which serves as the discharge orifice is readily apparent to a beautician using the device who realizes by mere observation that the left side, as viewed in FIG. 6**, is the side of the projection that should be laid downwardly toward the hair and thus assures proper placement of the device in her hand for use in making partings and applying the hair color altering liquid to the hair.

In the embodiment of the invention shown in FIG. 7 a conventional applicator cap 20*c* is used which comprises a cylindrical collar or flange 22*c*, a closure disc 24*a* having a discharge opening 26*c* centrally located therein around which a frustoconical projection is integrally formed which has a discharge passage 30*c* running therethrough to the small upper end 34*c*. An attachment 40*c* is used to convert this tip into a suitable one for discharging and spreading hair color altering liquids in the hair. This is done by providing an adapter 40*c* having a frustoconical recess 41 conforming in shape to the exterior surface of the projection 28*c* so that the adapter can be frictionally held in place on the cap. A passageway 42*c* is formed internally of the adapter to conduct liquid discharged from the passageway 30*c* through the end 34*c* from this discharge point to the discharge orifice 44*c* in the exterior surface of the adapter a substantial distance from the upper end thereof. Below the orifice the attachment includes a piece 43 which is somewhat trapezoidal in vertical section which engages the closure means 24*c* of the cap at the bottom where it extends radially outwardly at the lower end approximately to the periphery of the cap. This attachment provides a liquid spreading surface extending in a substantially straight line from the periphery to the upper end or tip so as to give the surface which engages the scalp and hair for spreading liquid discharged from the orifice 44*c* an approximately straight contour lying in a plane that clears 24*c* and converts an applicator cap that has very poor ability to spread liquid into one that is very efficient for this purpose.

The invention also contemplates a unitary molded plastic cap having the exterior contour of FIG. 7 with a spreading surface on at least one side 43A thereof lying in a plane that clears, i.e., does not intersect, the flange or the closure means, as seen in FIG. 7A. The extension of the projection at the lower end out to the periphery of the flange may be of any extent from full 360° to a few degrees to provide only a spreading surface of relatively narrow width, say one fourth inch or so. If the extension goes all around, the liquid passageway may be enlarged to save material, making the cap much like that shown in FIGS. 12 and 13.

The embodiment of the invention illustrated in FIG. 8 comprises a cap 20*d* having cylindrical flange 22*d* and closure disc 24*d* having an opening 26*d* therein leading to an elongated hollow projection 28*d* having a liquid passageway 30*d* therein leading to a plurality of discharge orifices 32*d* along the surface thereof which lies in a plane that clears the flange 22*d* and the disc 24*d* and is thus capable of lying against the scalp and hair during the parting and spreading operation. A second concentric flange 23 is formed integral with the closure disc 2*d* as illustrated. These two flanges or collars 22*d* and 23 are internally threaded to fit the necks of commercial squeeze bottles of different capacities, e.g., flange 23 may fit the five ounce size and 22*d* the eight ounce size of squeeze bottles. The discharge opening 26*d* is arranged to be within the innermost flange so that there is no leakage regardless of the size of squeeze bottle with which the cap is used.

The embodiment illustrated in FIG. 9 is similar in function to the devices illustrated in FIGS. 5, 6, 7 and 8 but differs in structure in that the projection 28*e* is formed integral with a one-piece molded plastic squeeze bottle 10*e* instead of being part of a removable cap. This bottle has a side wall, a wall closing the bottom end (not shown) and a top wall having a discharge outlet into the liquid passageway in the projection 28*e*. In this embodiment a separate filling opening comprising a short externally threaded neck (not shown), on which a closure cap 20*e* may be screwed, is provided for permitting the liquid that is to be used in the hair coloring operation to be introduced into the squeeze bottle 10*e*.

The discharge opening 32*e* illustrated in FIG. 9 is partly at the free end of projection 28*e* and partly in the side wall into which it extends downwardly as a slot for a sufficient distance to apprise a beautician using the device of the proper way of holding the squeeze bottle in the hand for use in making partings, discharging and spreading the liquid. The effect of this form of discharge orifice is very similar to the effect of the discharge orifice illustrated in FIG. 6 although physically different in structure.

The embodiment of the invention illustrated in FIG. 10 comprises a cap 20*f* having a flange or collar 22*f* that is internally threaded in the manner already described, a closure disc 24*f* having a discharge opening 26*f* therein adjacent to the flange 22*f* and a frustoconical projection 28*f* integral with the closure disc 24*f* surrounding the discharge opening 26*f*. The projection 28 has a discharge passage 30*f* extending into it and making it hollow and which leads to a discharge orifice 32*f* in the side wall a substantial distance from the tip 34*f*, as already described for the embodiments of the invention illustrated in FIGS. 1, 2, 3, 4, 5, 7 and 8. The axis of the frustoconical projection 28*f*, as illustrated is parallel to the axis of the flange 22*f*. This cap may be used directly on the squeeze boottle 10*f* since the internal thread on flange 22*f* was made to conform with the external screw on the neck 16*f* of the squeeze bottle in which case the device will be quite analogous in function and use to that illustrated in FIG. 8. It is advantageous, however, to have the axis of the projection 28*f* at an angle to the axis of the squeeze bottle as in FIGS. 5 and 9 and this may be achieved by the use of an adapter 50 which has an externally threaded flange 52 at one end and an interally threaded flange 54 at the other end with the axes of the flange 52 at an angle with respect to the axis of the flange 54 so as to tilt the axis of the projection 28*f* inwardly toward the axis of the squeeze bottle, thus bringing the axis of the projection into approximately the same relation to the axis of the squeeze as illustrated in the embodiment of FIG. 5. The threads on the exterior of flange 52 are essentially the same as the screw thread on the neck 16*f* and the internal thread or flange 54 is the same as the screw thread of the interior surface of flange 22*f*.

The use of the entire device as illustrated in FIG. 10 is essentially the same as the use of the devices illustrated in FIGS. 5, 6, 7, 8 and 9.

The embodiment of cap 20*g* illustrated in FIG. 11 comprises a flange or collar 22*g* adapted to be screwed onto the neck of the squeeze bottle (not shown), a closure means 24*g* having a discharge opening 26*g* therein and which is surrounded by a wall 60 in the form of a somewhat more than 180° recess or socket to receive an enlargement 62 at the large end of a frustoconical projection 28*g* which has a liquid passageway 30*g* therein. The projection 28*g* is only fragmentarily illustrated and it may terminate at the upper end with a discharge orifice (not shown) located in any of the ways illustrated in the other figures of the drawing. The cap is molded of elastomeric plastic which permits the wall 60 to spring outwardly far enough to permit the enlargement 62 to be snapped into place, as illustrated in FIG. 11, and to hold it with sufficient frictional force that the projection **28*g* will stay in the position in which it is placed during the use of the device for parting the hair and for discharging liquid from the squeeze bottle with which the cap is used through the discharge opening 26*g*, the discharge passage 30*g*** and discharge orifice wherever it may be placed.

The socket formed by the walls 60 may be cylindrical or spherical in shape, the former permitting motion of the projection in a single plane and the latter permitting universal motion. Alternatively, the ball or cylinder may be found on the cap and the socket or recess in the lower end of the projection. In both cases, the wall of the projection makes a movable, liquid tight connection with the wall surrounding the discharge outlet. The structure may also be used as a closure valve where the entrance to the passage **30*g* in the enlargement 62 is moved beyond the discharge opening 26*g* when the projection is turned downwardly as illustrated in FIG. 11**.

In the embodiments of the invention described in FIGS. 1–8, 10 and 11, the base of the projection is substantially smaller than the closure means for the collar or flange of the cap. The caps shown in the said FIGS. are also of the type which the prior art has used with squeeze bottles having cylindrical walls of larger diameter than the outside diameter of the flange which has necessitated a shoulder to connect the cylindrical wall to a neck of substantially smaller diameter. The embodiments of the invention illustrated in FIGS. 12–16 differ in that the squeeze bottle, when the cap is placed thereon, does not have a shoulder of larger outside diameter than that of the flange of the cap, and the base of the projection has substantially the same outside ciameter as the flange.

Referring first to FIG. 12, the squeeze bottle **10*h* is of somewhat L-shape in the front view depicted, with the upper end of the wall 12*h* circular in cross section forming a relatively short cylindrical portion. Below the cylindrical portion the bottle broadens out toward the base as viewed from the front and back but has essentially the same thickness as viewed from either side. The bottle is closed at the base by a bottom wall which has a flat portion that is capable of resting on a flat surface and may be in the form of a peripheral rib only or the entire bottom may be flat. The upper end of the cylindrical portion is slightly reduced to form a neck 16*h* around an axis, said neck having external threads 18*h* to cooperate with internal threads 24*h* on the inner surface of the flange 22*h* on the cap which is circular in cross section around an axis and which has the same external diameter as the upper cylindrical portion of the squeeze bottle 10*h*. The base or lower end of the projection 28*h* has essentially the same outside diameter as the flange 22*h* with which it is integral so that there is a smooth transition from the flange into the projection without any obstructing surfaces to interfere with a beautician laying an edge of the projection 28*h* flat against the scalp during a spreading operation. The projection 28*h* in this embodiment forms the closure means for flange 22*h* with the lower part of the projection 28*h* forming the discharge opening into the cap from the squeeze bottle which permits communication between the interior of the squeeze bottle and the passageway 30*h* in the projection 28*h*. The projection 28*h* may be of conical shape terminating in a somewhat rounded point 34*h* to facilitate entrance of the projection into the hair to form parts and the discharge orifice may be located in the side wall of the projection as shown in FIG. 12 or, if desired, may be any of the types of discharge orifices shown in the figures of the drawing already described. The bottle itself is not symmetrical about the axis of the neck 16*h* and the axis of the neck may be perpendicular to the plane passing through the flat portion of the base, if desired, or at an angle to a line perpendicular to the base, as shown. In FIG. 12 the bottle itself has means, viz., the shape of the side walls, to tilt the axis of the elongated projection without use of an adapter such as the one shown in FIG. 10**.

FIG. 13 shows a different embodiment of the invention in which the squeeze bottle itself is of frustoconical shape with the angle that the walls make with a flat part of the base the same as the angle that the walls of the projection **28*i* make with a plane perpendicular to its axis. The upper end of the conical wall 12*i* of the squeeze bottle 10*i* terminates in a neck 16*i* of somewhat smaller diameter about an axis. The neck, which may be either conical or cylindrical in shape, bears a thread 18*i* on the external surface thereof to cooperate with an internal thread 24*i* on the flange 22*i* which, when screwed down on the neck, forms with the squeeze bottle 10*i* a simple cone without obstructions to interfere with a beautician laying the projection 28*i* against the scalp during the operation of spreading liquid discharged along the part line into the hair. This bottle is symmetrical about the axis of its neck, which axis is aligned with the axis of the cap about which its side wall is symmetrical. In this embodiment also the projection 28*i* serves as the closure means for the flange 22*i*, as already stated in the description of the cap of FIG. 12. The projection 28*i* terminates in a somewhat rounded end 34*i* to facilitate entrance thereof into the hair to part it. The liquid discharge orifice 32*i* is illustrated in the side wall of the projection 28*i* a substantial distance from end 34*i* but it will be understood that the location of the discharge orifice may also be at the upper end as illustrated in FIG. 14 in which the projection 28*k* arises from the flange 22*k* to form a cone terminating with the discharge orifice 32*k* at the upper end 34*k* and communicating with the squeeze bottle (not shown in this FIG.) by means of passage 30*k***.

FIGS. 15 and 16 illustrate an embodiment of the invention in which a cap is provided having a flange **22*m* to secure the projection 28*m* to a squeeze bottle of the type 10*i* illustrated in FIG. 13 and which is provided with a special liquid spreading surface 70 lying in a plane that does not intersect the flange, said spreading surface having substantially parallel sidewalls formed by recessing the cone at 72 on each side of the surface 70. A discharge orifice 32*m* is provided in a convenient location, which may be in or adjacent to the surface 70 and which communicates by means of a passageway (not shown) in the projection 28*m* that communicates with the interior of the squeeze bottle thereof. Looking at FIG. 16, it will be apparent that the tendency of a spreading device of circular construction to slide over liquid laid along a part line is overcome by this construction which can operate like a spatula or blade and thereby greatly enhance the spreading capability over the capability of a conical cap. The spreading surface 70 may have any desired length, e.g., it may extend from the hair penetrating end 34***m* to the flange 22*m*, as shown in FIG. 15, or it may be shorter, e.g., extending from the end 34*m* to the vicinity of the discharge orifice 32*m* or any intermediate point between orifice 32*m* and flange 22*m*. Preferably the recesses 72 are not made so long or so deep as to provide pockets for troublesome accumulation of liquids being spread by the device.

It will be understood by those skilled in the art that the various forms of discharge orifices illustrated in the different embodiments of the invention may be used interchangably. Thus the form of discharge orifice 32*e* in FIG. 9 may be used equally well in the embodiments of FIGS. 1, 3, 5, 6, 7, 8, 10, 11, 12, 13, 14, 15 and 16 and vice versa. Similarly any of the caps of FIGS. 1–7 and 10 may have a plurality of flanges or collars such as illustrated in the embodiment of FIG. 8. If desired, the neck of the squeeze bottle may be threaded internally and the flange externally without departing from the principle of the invention. It will also be understood that a bottle may be molded which has the axis of the neck at an angle with respect to the axis of the cylindrical wall of the bottle and thus eliminate the need for an adapter 50. Other modifications and variations may be made in the structure of the devices as those skilled in the art will understand.

The caps and squeeze bottles of the present invention may be made from any suitable material, particularly such materials as have been used in making squeeze bottles heretofore. Among the more popular materials are polyethylene and polypropylene plastics which have a somewhat milky opalescent appearance when used without fillers and which can be colored from white to black with all intermediate colors by incorporation of pigments in the plastic mix used in molding the bottles and caps. The invention contemplates the use of contrasting colors on opposite sides of the projection as means for indicating the side that should be placed against the scalp in the liquid spreading operation. For example, the side to be placed against the scalp could be opaque, e.g., black, red, white, etc., while the opposite side is transparent or translucent which would enable an operator to see the color altering liquid flowing through the passageway to the discharge orifice. This color means may be used with or in the place of the other means for indicating which side to be placed against the scalp such as a discharge orifice partly or entirely in that side, as described above. Other plastics, however, may be used for the cap which are less flexible than polyolefines such as polyvinyl chloride, polyacrylates, polymethacrylates, Lucite, nylon, and the like. It is of advantage in some cases to make the cap partly or entirely of transparent or translucent plastic because any adhering color altering liquid that may remain in the cap when a hair coloring operation has been finished may readily be seen. All of this adhering liquid that is visible in such a cap can be readily removed with a brush or the like and thus be made ready for sanitary usage on the next customer.

Having thus described and illustrated various embodiments of the invention, what is claimed is:

1. A hair parting and liquid spreading device comprising a tubular flange surrounding an axis having means for removably holding the device in liquid tight relation to a squeeze bottle, closure means secured to the upper end of said tubular flange having a discharge outlet therein, and an elongated, hollow projection surrounding an axis connected at one end to and extending upwardly from said closure means around said discharge outlet, said projection having an outside dimension in cross section at the end connected to said closure means which is small relative to the dimension of said closure means and terminating in an opposite end capable of penetrating and parting the hair and having a liquid spreading surface on a side wall extending upwardly from said closure means adjacent to its periphery, and there being at least one discharge orifice in the liquid spreading surface thereof.

2. A hair parting and liquid spreading device as set forth in claim 1 in which said discharge orifice is spaced a substantial distance from the hair penetrating end thereof which is closed.

3. A hair parting and liquid spreading device as set forth in claim 1 in which there are a plurality of discharge orificies in the liquid spreading surface of said projection.

4. A hair parting and liquid spreading device as set forth in claim 1 in which the discharge orifice is spaced a short distance from the hair penetrating end of the projection.

5. A hair parting and liquid spreading device as set forth in claim 4 in which the discharge orifice formed in the liquid spreading surface extends into the hair penetrating end of the projection in the form of a slot.

6. A hair parting and liquid spreading device as set forth in claim 4 in which the rim of the discharge orifice formed in the liquid spreading surface extends into the hair penetrating end of the projection on a plane at an acute angle to a plane perpendicular to the axis of said projection.

7. A hair parting and liquid spreading device as set forth in claim 1 in which said projection comprises two separable, parts, a first part of frustoconical external shape integral with the closure means at its larger end and having a discharge orifice at the smaller free end and the second part having said liquid spreading surface and said hair penetrating and parting end and a frustoconical recess to fit tightly over and be frictionally held on the frustoconical integral part, said discharge orifice in said liquid spreading surface thereof being connected by a passageway to said discharge orifice in said first part when the second part is tightly fit on said first part.

8. A hair parting and liquid spreading device as set forth in claim 1 in which said flange is cylindrical and said hollow projection extends upwardly with its axis parallel to the axis of said flange.

9. A hair parting and liquid spreading device as set forth in claim 1 in which said flange is cylindrical and said hollow projection extends upwardly with its axis parallel to and aligned with the axis of said flange.

10. A hair parting and liquid spreading device as set forth in claim 1 in which said flange is cylindrical and said hollow projection extends upwardly with its axis at an acute angle with respect to the axis of said flange.

11. A hair parting and liquid spreading device as set forth in claim 10 in which the projection originates adjacent to the flange and its axis diverges from the axis of the flange.

12. A hair parting and liquid spreading device as set forth in claim 10 in which said projection originates adjacent to the flange and its axis converges toward the axis of the flange.

13. A hair parting and liquid spreading device as set forth in claim 1 in which said flange is cylindrical and is threaded internally to fit an external thread on the neck of a squeeze bottle.

14. A hair parting and liquid spreading device as set forth in claim 13 in which said device includes a second internally threaded cylindrical flange and the discharge outlet in said closure means is inside said second flange.

15. A hair parting and liquid spreading device comprising a one-piece molded plastic squeeze bottle having a side wall, a wall closing the bottom end and a top wall having a discharge outlet; an elongated hair parting and liquid spreading projection comprising a wall connected with said top wall in liquid tight relation around said discharge outlet and a liquid passageway communicating with said discharge outlet; a discharge orifice in the wall of said projection communicating with said liquid passageway; and the wall of said projection having a surface adapted to spread liquid discharged through said discharge outlet.

16. A hair parting and liquid spreading device as set forth in claim 15 in which said top wall includes a filling opening and a removable cap adapted to make liquid tight connection with said filling opening.

17. A hair parting and liquid spreading device as set forth in claim 15 in which said top wall is integral with said projection and said discharge orifice is at an intermediate position in said spreading surface.

18. A hair parting and liquid spreading device comprising in combination a squeeze bottle having a threaded cylindrical neck surrounding an axis and a removable cap for closing said neck, said cap comprising a threaded cylindrical flange surrounding an axis removably securing the cap in liquid tight relation to said neck, an elongated projection having a wall surrounding an axis secured at the lower end to and extending upwardly from said flange and a liquid passageway communicating with the interior of said squeeze bottle, said projection terminating in an upper end capable of penetrating and parting the hair and having a liquid spreading surface on said wall extending upwardly from said flange adjacent to its periphery to said upper end, and at least one discharge orifice in the liquid spreading surface thereof communicating with said liquid passageway.

19. A hair parting and liquid spreading device as set forth in claim 18 in which said cap comprises a closure means secured to the upper end of said flange, said closure means having a discharge outlet, the lower end of the wall of said projection being connected to said closure means around said discharge outlet, and a second cylindrical, threaded flange on said closure means of smaller diameter than and with its axis parallel to the axis of said first mentioned cylindrical flange and said discharge outlet is within said second flange.

20. A hair parting and liquid spreading device as set forth in claim 18 in which the axis of said projection is aligned with the axis of said flange.

21. A hair parting and liquid spreading device as set forth in claim 18 in which the axis of said projection is offset from the axis of said flange.

22. A hair parting and liquid spreading device as set forth in claim 18 in which the squeeze bottle is symmetrical about the axis of its cylindrical neck and the axis of said projection is offset from the axis of said flange, and means for tilting the axis of said projection with respect to the axis of the squeeze bottle.

23. A hair parting and liquid spreading device as set forth in claim 22 in which said means for tilting the axis of the projection with respect to the axis of said squeeze bottle is a tubular adapter having means at one end to secure it removably to said squeeze bottle and means at the other end to secure it removably to said cap.

24. A hair parting and liquid spreading device comprising a tubular flange having means for removably holding it in liquid tight relation to a squeeze bottle; closure means secured to the upper end of said tubular flange having a discharge outlet therein, said discharge outlet having a surrounding wall, an elongated projection comprising a wall surrounding a liquid passageway, the wall of said projection making a movable, liquid tight connection with the wall surrounding said outlet, and a discharge orifice at an intermediate position in the wall of said projection.

25. A hair parting and liquid spreading device comprising a tubular flange having means for removably holding it in liquid tight relation to a squeeze bottle; closure means secured to the upper end of said tubular flange having a discharge outlet therein adjacent to said flange; and an elongated projection having a wall surrounding a liquid passageway extending upwardly from said closure means around said discharge outlet, the axis of said projection converging toward the axis of the flange, said projection having a discharge orifice at an intermediate position in the wall thereof communicating with said liquid passageway.

26. A hair parting and liquid spreading device comprising an elongated projection for parting hair having a liquid discharge passage therein, an elongated liquid spreading surface on a side wall of said projection, a discharge orifice on said projection at an intermediate position in said spreading surface communicating with said discharge passage, and means for securing said projection in liquid tight relation to a squeeze bottle with its axis offset from the axis of the squeeze bottle and with said discharge passage in communication with the interior of said squeeze bottle whereby a liquid in said squeeze bottle may be discharged through the discharge orifice in the liquid spreading surface on said projection and be spread in the hair by said spreading surface on both sides of said discharge orifice.

27. A hair parting and liquid spreading device comprising a squeeze bottle having a neck, a tapered cap terminating at the upper end in a smooth point capable of penetrating and parting the hair and at the lower end in a flange removably securing the cap to the neck of the squeeze bottle, the adjacent parts of said squeeze bottle and flange having the same external size and shape, and means forming a liquid discharge orifice in the surface of the tapered portion of said cap that communicates with the interior of said squeeze bottle.

28. A hair parting and liquid spreading device as set forth in claim 27 in which said squeeze bottle is generally L-shaped.

29. A hair parting and liquid spreading device as set forth in claim 27 in which said squeeze bottle and the cap provide a conical unit when assembled together.

30. A hair parting and liquid spreading device as set forth in claim 27 in which said cap is provided with a spreading surface having substantially parallel sides to increase the liquid spreading capability and said discharge orifice is located in said spreading surface.

31. A hair parting and liquid spreading device as set forth in claim 27 in which said orifice is a least partially in the side wall of the cap.

32. A hair parting and liquid spreading device as set forth in claim 27 in which said orifice is at the small end of the cap.

33. A hair parting and liquid spreading device as set forth in claim 27 in which said orifice is wholly in the side wall of the cap.

34. A hair parting and liquid spreading device comprising a one piece plastic molded cap comprising a flange for removably securing it to a squeeze bottle, an elongated projection connected to and extending upwardly from said flange terminating in an end capable of penetrating and parting hair, said projection having a liquid spreading surface capable of being laid on the scalp without substantial interference from said flange, said projection having a liquid discharge passage therein and a discharge orifice thereon communicating with said discharge passageway, said discharge orifice being located at least partially on said spreading surface.

35. A hair parting and liquid spreading device comprising a tubular flange surrounding an axis having means for removably holding the device in liquid tight relation to a squeeze bottle; closure means secured to the upper end of said flange having a discharge outlet therein adjacent to said flange; an elongated, hollow projection capable of penetrating and parting the hair extending upwardly from said closure means around said discharge outlet and surrounding an axis extending upwardly parallel to but offset from the axis of said flange, and means forming a liquid discharge orifice in said projection communicating with said discharge outlet.

36. A hair parting and liquid spreading device comprising a cylindrical flange surrounding an axis having means for removably holding the device in liquid tight relation to a squeeze bottle; closure means secured to the upper end of said flange having a discharge outlet therein adjacent to said flange; an elongated, hollow projection capable of penetrating and parting the hair extending upwardly from said closure means around said discharge outlet and surrounding an axis extending upwardly at an angle converging toward the axis of said flange; and means forming a liquid discharge orifice in said projection communicating with said discharge outlet.

37. A hair parting and liquid spreading device comprising outer and inner cylindrical flanges surrounding an axis, each flange having means for removably holding the device in liquid tight relation to the neck of a squeeze bottle; closure means secured to the upper end of each flange having a discharge outlet therein within said inner flange; an elongated, hollow projection capable of penetrating and parting the hair extending upwardly from said closure means around said discharge outlet, and means forming at least one discharge orifice in said projection communicating with said discharge outlet.

38. A hair parting and liquid spreading device comprising in combination a squeeze bottle and a cap, said bottle having a bottom wall at one end having a flat portion capable of resting on a flat surface and an externally threaded neck at the other end surrounding an axis, said cap comprising an internally threaded flange surrounding an axis removably securing the cap in liquid tight relation to said neck; a closure means secured to the upper end of sad flange in the form of an elongated, hollow projection surrounding an axis extending upwardly from said flange and terminating in an end capable of penetrating and parting the hair and having at least one liquid discharge orifice in a surface thereof, said flange having substantially the same size in cross section as the adjacent portion of said squeeze bottle.

39. A hair parting and liquid spreading device as set forth in claim 38 in which said squeeze bottle is symmetrical about the axis of its neck.

40. A hair parting and liquid spreading device as set forth in claim 38 in which said squeeze bottle is nonsymmetrical about the axis of its neck.

41. A hair parting and liquid spreading device as set forth in claim 38 in which said squeeze bottle is symmetrical about the axis of its neck and is of conical shape.

42. A hair parting and liquid spreading device as set forth in claim 38 in which said squeeze bottle is nonsymmetrical about the axis of its neck and the axis of said projection is at an angle to a line perpendicular to the flat portion of said bottom wall.

43. A hair parting and liquid spreading device comprising in combination a squeeze bottle and a cap, said bottle having a bottom wall at one end having a flat portion capable of resting on a flat surface and an externally threaded neck at the other end surrounding an axis and said cap comprising an internally threaded flange surrounding an axis removably securing the cap in liquid tight relation to said neck; a closure means secured to the upper end of said flange in the form of an elongated, hollow projection surrounding an axis extending upwardly from said flange and terminating in an end capable of penetrating and parting the hair and having at least one liquid discharge orifice in a surface thereof, and means for tilting the axis of said projection with respect to a line perpendicular to the flat portion of said bottom wall.

44. A hair parting and liquid spreading device as set forth in claim 43 in which said means for tilting the axis of said projection is a tubular adapter having means at one end to secure it removably to said squeeze bottle and means at the other end to secure it removably to the cap.

45. A hair parting and liquid spreading device as set forth in claim 43 in which said means for tilting the axis of said projector is integral with the bottle and tilts the axis of the neck at an angle to a line perpendicular to a plane through the flat portion of the bottom wall.

46. A hair parting and liquid spreading device comprising a cap having means for removably securing it in liquid tight relation to a squeeze bottle, and elongated hollow projection extending upwardly from said means having a spreading surface thereon comprising substantially parallel side surfaces, said projection terminating in an end capable of penetrating and parting the hair, and means forming a discharge orifice in said projection capable of communicating with the interior of a squeeze bottle when the cap is secured thereto.

47. A hair parting and liquid spreading device comprising a tubular flange surrounding an axis having means for removably holding the device in liquid tight relation to a squeeze bottle; closure means secured to the upper end of said tubular flange having a discharge outlet therein; and an elongated, hollow projection surrounding an axis extending upwardly from said closure means around said discharge outlet, said projection terminating in an end capable of penetrating and parting the hair and having a liquid spreading surface on a side wall thereof lying in a plane that does not intersect said flange or said closure means and there being at least one liquid discharge orifice which is at least partly in the liquid spreading surface thereof.

48. A hair parting and liquid spreading device comprising a tubular flange surrounding an axis having means for removably holding the device in liquid tight relation to a squeeze bottle; closure means secured to the upper end of said tubular flange having a discharge outlet therein; and an elongated, hollow projection surrounding an axis extending upwardly from said closure means around said discharge outlet, said projection terminating in an end capable of penetrating and parting the hair and having such size and shape as to provide a liquid spreading surface on a side thereof that permits spreading liquid from a part line anywhere on the head into adjacent hair without contacting the head with the flange or closure means.

49. A hair parting and liquid spreading device comprising a tubular flange surrounding an axis having means for removably holding the device in liquid tight relation to a squeeze bottle; closure means secured to the upper end of said tubular flange having a discharge outlet therein; and an elongated, hollow projection surrounding an axis extending upwardly from said closure means around said discharge outlet, said projection terminating in an end capable of penetrating and parting the hair and having a surface on a side wall thereof adapted to be a spreading surface, said projection having means for indicating which side is adapted to be the spreading surface.

50. A hair parting and liquid spreading device as set forth in claim 49 in which said indicating means is a discharge orifice at least partly in said spreading surface.

51. A hair parting and liquid spreading device as set forth in claim 49 in which said indicating means is a color on said spreading surface different from the color on the opposite side surface.

52. A hair parting and liquid spreading device as set forth in claim 49 in which said indicating means is a discharge orifice at least partly in said spreading surface and a color on said spreading surface different from the color on the opposite side surface.

53. A hair parting and liquid spreading device adapted for use with and to serve as a closure for a squeeze container having a discharge opening comprising attaching means adapted removably to secure the device in liquid tight relationship to said container around said discharge opening, said attaching means having a circular periphery, means secured to said attaching means adapted for closing the opening of a squeeze container including a projection secured at one end to said attaching means and extending upwardly to a hair penetrating and parting tip at the other end thereof, a liquid spreading surface on said device extending in a substantially straight line from said periphery to said tip, a discharge orifice in said spreading surface at an intermediate position between said periphery and said tip, and a discharge passageway in said device connecting said orifice with the interior of a squeeze container through said discharge opening when the device is attached thereto by said attaching means.

* * * * *